US007837557B2

(12) United States Patent
Boyd

(10) Patent No.: US 7,837,557 B2
(45) Date of Patent: Nov. 23, 2010

(54) METHOD AND APPARATUS FOR COMMUNICATING WITH A PLAYER OF A NETWORKED GAMING DEVICE

(75) Inventor: Scott A. Boyd, Las Vegas, NV (US)

(73) Assignee: IGT, Reno, NV (US)

( * ) Notice: Subject to any disclaimer, the term of this patent is extended or adjusted under 35 U.S.C. 154(b) by 251 days.

(21) Appl. No.: 10/170,238

(22) Filed: Jun. 11, 2002

(65) Prior Publication Data

US 2003/0109307 A1 Jun. 12, 2003

Related U.S. Application Data

(60) Provisional application No. 60/297,490, filed on Jun. 11, 2001.

(51) Int. Cl.
*A63F 9/24* (2006.01)

(52) U.S. Cl. ..... 463/31; 463/40; 463/41; 463/42; 463/43

(58) Field of Classification Search ..... 463/16–22, 463/40–43, 31, 34
See application file for complete search history.

(56) References Cited

U.S. PATENT DOCUMENTS

| | | | | |
|---|---|---|---|---|
| 4,856,787 | A * | 8/1989 | Itkis | 273/237 |
| D379,202 | S | 5/1997 | Takemoto et al. | |
| 5,655,961 | A | 8/1997 | Acres et al. | |
| 5,919,091 | A * | 7/1999 | Bell et al. | 463/25 |
| 5,951,397 | A | 9/1999 | Dickinson | |
| 6,089,976 | A * | 7/2000 | Schneider et al. | 463/16 |
| 6,113,495 | A | 9/2000 | Walker et al. | |
| 6,190,254 | B1 | 2/2001 | Bennett | |
| D445,841 | S | 7/2001 | Sabo | |
| 6,315,666 | B1 | 11/2001 | Mastera et al. | |
| 6,319,125 | B1 | 11/2001 | Acres | |
| 6,368,216 | B1 * | 4/2002 | Hedrick et al. | 463/20 |
| 6,371,852 | B1 | 4/2002 | Acres | |
| 6,375,567 | B1 | 4/2002 | Acres | |
| 6,375,569 | B1 | 4/2002 | Acres | |
| 6,466,274 | B1 * | 10/2002 | White | 348/649 |
| D465,531 | S | 11/2002 | Luciano, Jr. et al. | |
| 6,511,377 | B1 * | 1/2003 | Weiss | 463/25 |
| D473,899 | S | 4/2003 | Munoz et al. | |
| 6,579,179 | B2 * | 6/2003 | Poole et al. | 463/25 |
| 6,722,985 | B2 * | 4/2004 | Criss-Puszkiewicz et al. | 463/29 |
| 6,860,811 | B1 | 3/2005 | Wilkins | |
| 2002/0142825 | A1 | 10/2002 | Lark et al. | |
| 2002/0142846 | A1 | 10/2002 | Paulsen | |
| 2003/0054881 | A1 | 3/2003 | Hedrick et al. | |

FOREIGN PATENT DOCUMENTS

| | | |
|---|---|---|
| AU | 704691 | 4/1999 |
| EP | 0769769 A1 | 4/1997 |

* cited by examiner

*Primary Examiner*—Peter Dungba Vo
*Assistant Examiner*—Omkar Deodhar
(74) *Attorney, Agent, or Firm*—Weaver Austin Villeneuve & Sampson LLP

(57) ABSTRACT

This embodiment of a method and apparatus for communicating with a player of a networked gaming device incorporates a touch screen display into an electronic slot machine. The display facilitates player interaction with the slot machine network to enable cashless gaming, player tracking, bonus, and secondary game features.

6 Claims, 11 Drawing Sheets

METHOD AND APPARATUS FOR COMMUNICATING WITH A PLAYER OF A NETWORKED GAMING DEVICE

This patent application claims priority from U.S. Provisional Patent Application Ser. No. 60/297,490, filed Jun. 11, 2001, which is hereby incorporated by reference for all purposes.

BACKGROUND

1. Field of the Invention

The present invention relates to a player interface associated with an electronic gaming device and, more particularly, to such an interface that includes a display and an input device to provide interactive communication with the player.

2. Background of the Invention

Incorporating casino slot machines into a computer network is well known. Early in the deployment of such networks, preexisting slot machines were retrofitted by installing a communications board that included a processor, memory and other components that facilitated communications between the electronic slot machine and the network. When so configured, transactions at one of slot machines could be communicated via the board onto the network and from there to a computer that stored the transactions for later analysis and verification. Conversely, the network computer can issue commands onto the network that are addressed to a particular machine or a group of machines. The communications board receives the command and communicates with the slot machine to effect, for example, payment of a bonus over and above the pay table in the slot machine as described in U.S. Pat. No. 5,655,961, which is owned by the assignee of the present application and which is incorporated herein by reference for all purposes.

In addition to the communications board, it is well known to install a card reader, a display, and a keypad at each slot machine to facilitate player tracking, as it is referred to in the industry. In a conventional player-tracking system, each player is assigned a card and an associated account, which is maintained on a network computer. Before playing one of the slot machines, the player inserts his or her card to cause points proportionate to play to accrue in his or her account. The points are then redeemable by the player for additional play, dinners, merchandise, or the like. In addition, the card, keypad and display, which is typically a vacuum fluorescent display or a small-character LCD display, can be used to permit a player to access a cashless play account or to access credits that are either complimentary or awarded to the player during the course of his or her play.

The design, construction and operation of networked slot machines, including the card reader, the keypad and the display, as mentioned above, is described in detail in the '961 patent. Another embodiment is also described in U.S. Pat. No. 6,319,125 for a Method and Apparatus for Promoting Play on a Network of Gaming Devices, which is also assigned to the assignee of the present application and which is also incorporated herein by reference for all purposes.

In addition to player-tracking functions, cashless play and associated functions can be implemented using the system of FIG. 1 as described in U.S. patent application Ser. No. 09/694,065, which is assigned to the assignee of the present application and which is incorporated herein by reference for all purposes. In addition, conversion of player-tracking points into playable credit can also be implemented using the system of FIG. 1 as described in U.S. patent application Ser. No. 09/134,598, now U.S. Pat. No. 6,371,852 which is also assigned to the assignee of the present application and which is also incorporated herein by reference for all purposes.

SUMMARY

In one aspect, the invention features a method for operating networked gaming devices. The method comprises permitting a player to play one or more gaming devices and providing services to the player via the network. The services are related to the play of the gaming devices. The method also comprises communicating information to the player about the network services via a touch screen display associated with the gaming device and accepting a communication from the player via the touch screen display.

In another aspect, the invention features an apparatus for communicating with a player of a gaming device on a network of gaming devices. The apparatus comprises a display associated with the networked gaming device. The display is operatively connected to the gaming device network. A computer is operatively connected to the network. The computer generates information about services provided to the player. A circuit is associated with the display for creating images on the display responsive to such information. A touch screen is associated with the display for accepting communications from the player.

DETAILED DESCRIPTION OF THE PREFERRED EMBODIMENTS

Turning first to FIGS. 1-4, indicated generally at 10 is the upper portion of a slot machine. The slot machine is a commercially available electronic gaming device that has been modified as described herein.

Figure 7:
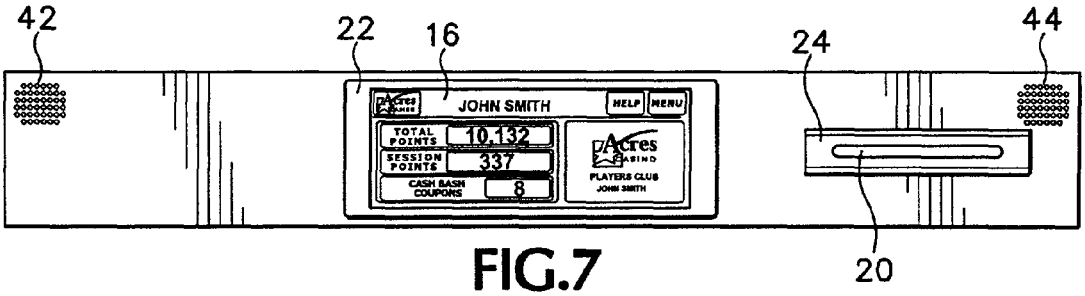
FIG. 7 is a view of the display and card reader on the slot machine of FIG. 1, including an image depicted on the display screen.

One aspect of the modifications to slot machine 10 includes addition of a bracket 14 mounted on the front of the slot machine. The bracket includes two openings, the first containing a 640×240 touch-panel liquid crystal display ("LCD") 16. In the present embodiment of the invention, LCD 16 comprises a Hitachi SX16H005-AZA LCD. The second opening 18, in FIG. 1, contains a card reader having a slot 20 (visible in FIG. 7), into which a player's card is received as is known in the art. As shown in FIG. 7, both LCD 16 and slot 20 are framed by respective bezels 22, 24. Card reader bezel 24 and slot 20 are not shown in FIG. 1.

Figure 1:
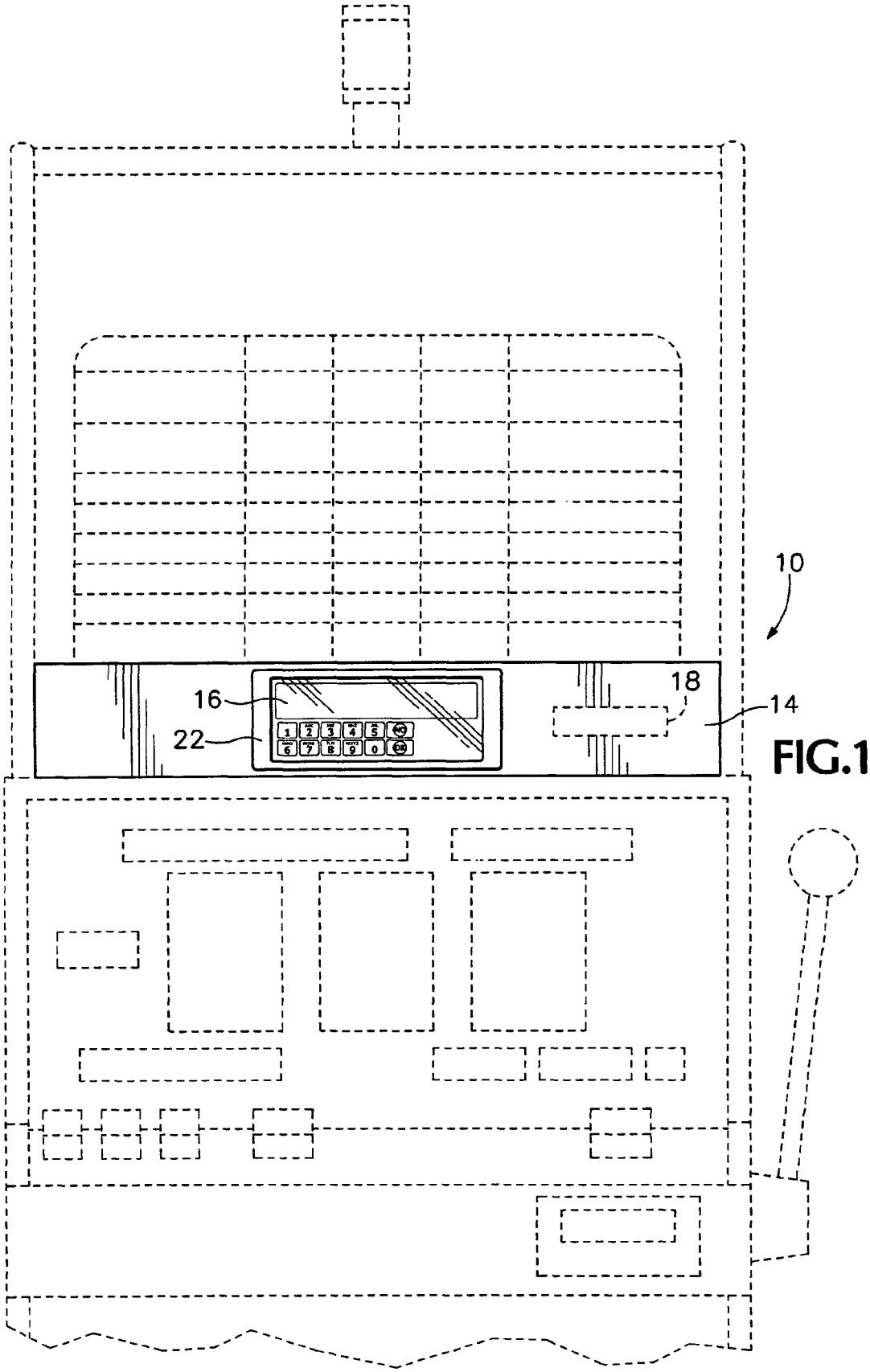
FIG. 1 is a partial view of a slot machine, shown in dashed lines, that is part of an implementation of the present embodiment of the invention, including an interactive display screen and card reader, shown in solid lines.
Figure 3:
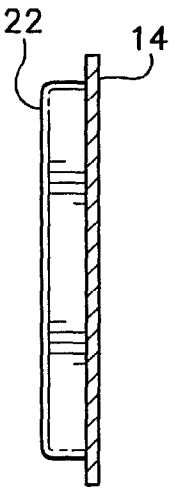
FIG. 3 is a right-side view of the display of FIG. 2.
Figure 2:
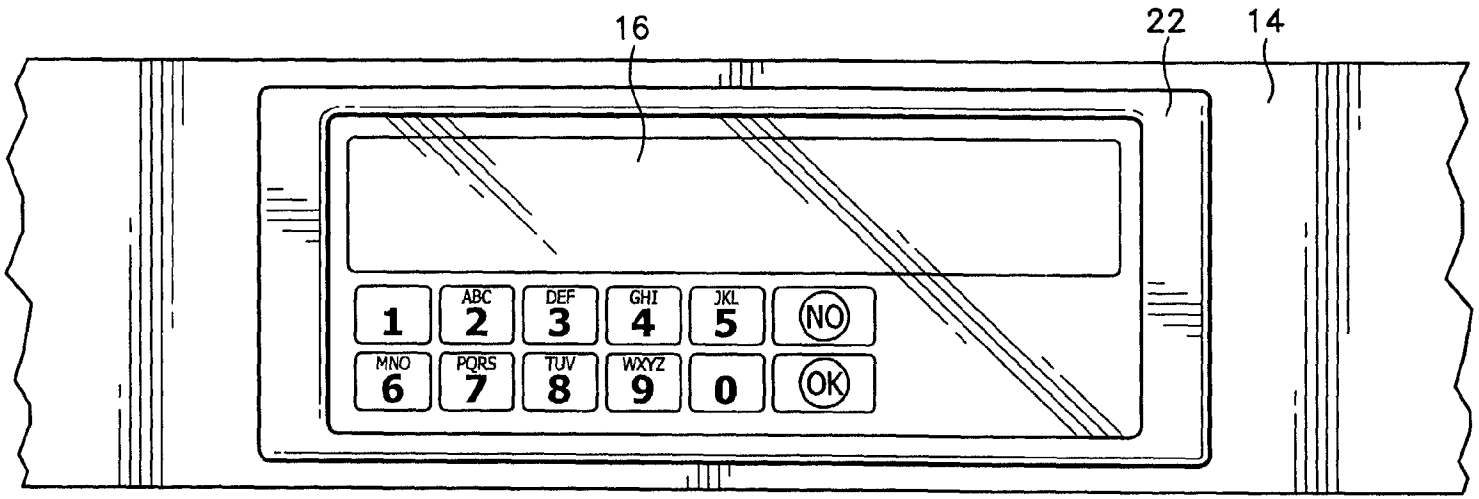
FIG. 2 is an enlarged partial view of the display of FIG. 1.
Figure 4:
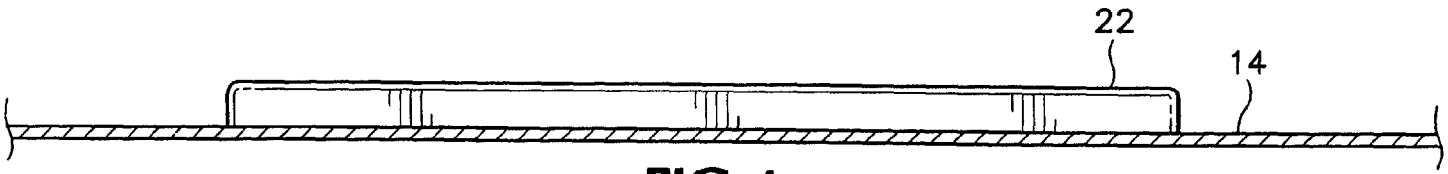
FIG. 4 is a bottom view of the view of FIG. 2.
Figure 5:
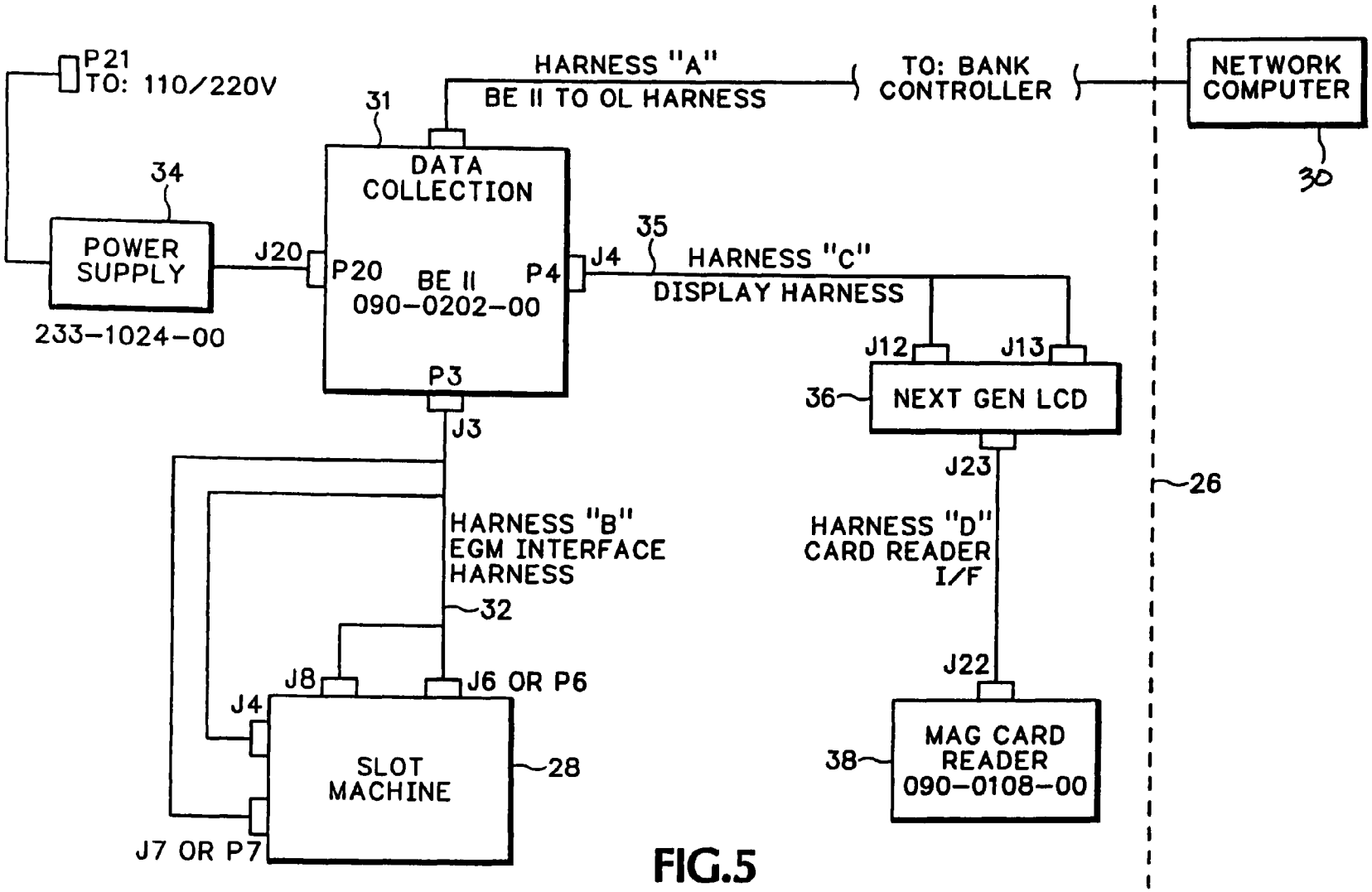
FIG. 5 is a schematic view of the slot machine display and card reader of FIG. 1 depicting the manner in which circuitry associated with each is connected to a network of similar slot machines incorporating displays and card readers.

Turning now to FIG. 5, the schematic components depicted therein on the left side of dashed line 26 are all contained within the cabinet that houses slot machine 10 in FIG. 1. Slot machine electronics 28 is part of the original slot machine structure provided by the slot-machine manufacturer. The additional components on the left side of line 26, however, are all added to implement the invention in association with electronics 26 and the network.

The components within the slot machine, i.e., on the left side of line 26, are connected to a computer network, along with numerous additional slot machines having the related structure depicted in FIG. 5. The network is illustrated as a computer 30 on the right side of dashed line 28. Networked slot machines are known in the art and are depicted in '961 and '125 patents. The network includes databases for storing slot machine transactions and player tracking data, servers for implementing system games and bonuses, configuration work stations for configuring the system games and bonuses, and a Content Manager, which is a program implemented on a network computer that permits an operator of the system, typically a casino, to customize and configure images that appear on display 16.

The slot-machine electronics 28 are connected to a system-machine interface board 31 via a wiring harness 32. Board 31 provides communications between the slot machine electronics 28 and network 30 in a manner that is described in the '961 and '125 patents. A power supply 34 provides power to board 31. A wiring harness 35 connects board 31 with the display and associated electronics 36. Another harness connects board 31 to the network including computer 30. The power supply also supplies power to electronics 36 and to a card reader 38. The card reader is behind bezel 24 in FIG. 7 and includes slot 20.

Figure 6:
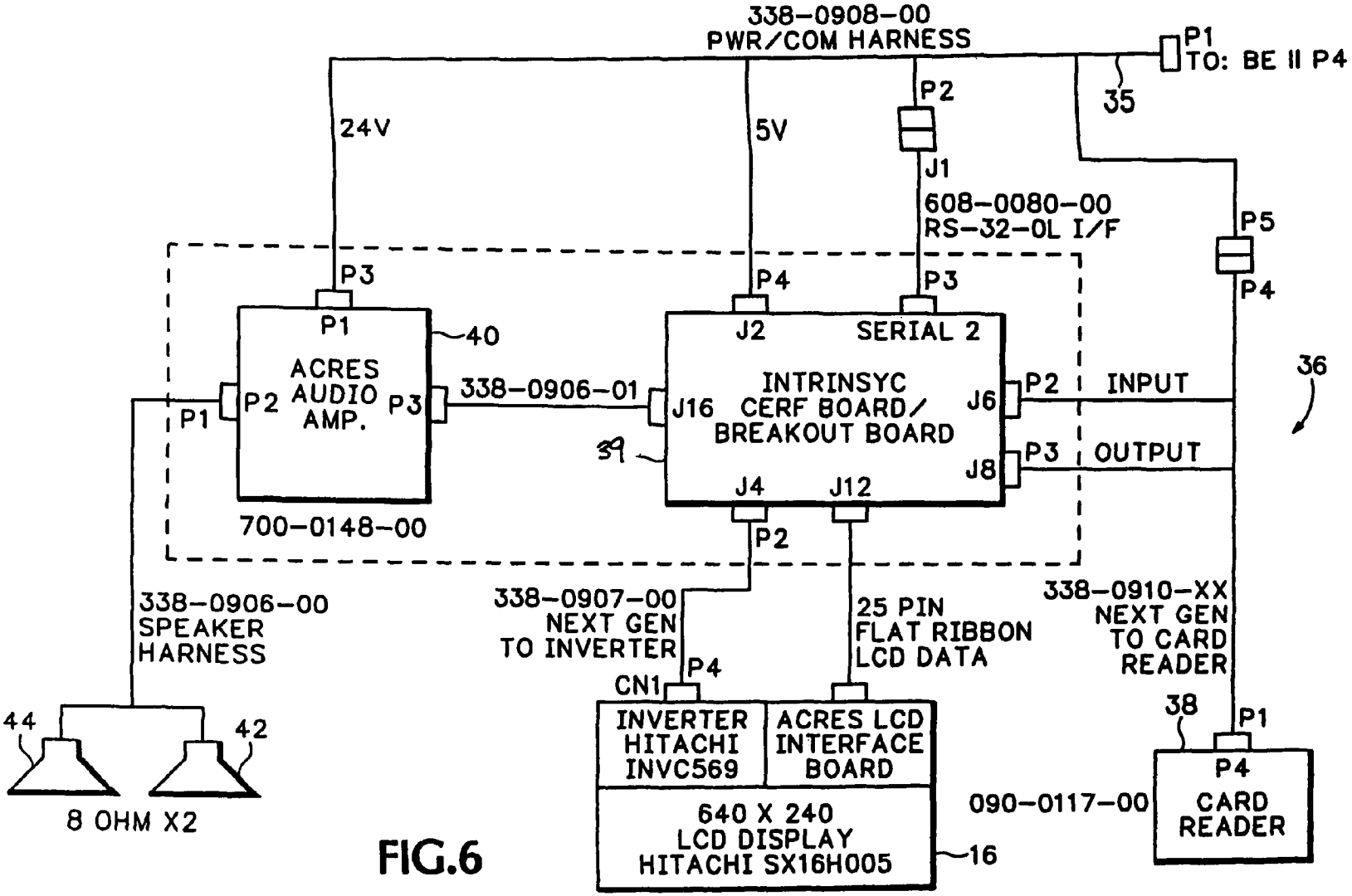
FIG. 6 is a schematic view of the display and related components of FIG. 5.

Turning now to FIG. 6, additional details of the display and associated electronics 36 in FIG. 5 are depicted schematically.

A dedicated computer 39 includes an LCD controller and electronics for enabling VGA touch panel images and sound for LCD 16. In the present embodiment of the invention, computer 39 is a commercially available processor board manufactured by Intrinsyc. It includes an Intel ARM processor and a Windows CE operating system. Computer 39 also includes nonvolatile memory for storing images and sounds that are utilized as described hereinafter. An amplifier 40 provides sound signals to speakers 42, 44, which are partially visible in FIG. 7.

In the present embodiment of the invention, the networked slot machines are initially configured using the Content Manager, which—in the present embodiment of the invention—runs on the same network PC platform as a configuration work station, which enables files to be downloaded to the system-machine interface board, like board 31, associated with each slot machine. Once the screens and features of individual screens are selected at the Content Manager, an initialization file is created that identifies which MMC files and features have been selected. The configuration workstation can then be used to download the initialization file and associated MMC files to all the machines, to groups of machines, or even to a single selected machine. These initialization files and associated MMC files are stored in nonvolatile memory in electronics 36. All parameters associated with the audio content and with display 16 can be configured in this manner.

In operation of the prior art VFD, System Tokens—such as a player's name or accrued points—are embedded in a slot-machine message comprising otherwise constant text strings that appear on the VFD. For example in the message Hello Richard, Hello comprises a constant text string and Richard comprises the System Token, here, the player name associated with the player card in use.

In the present invention, an MMC Token is embedded in the prior art VFD message, which may include System Tokens, that is transmitted to board 31 by the network and from there to board 39. As a result, if the message is received by a slot machine with a VFD, the usual VFD message is displayed. If it is received by a slot machine with an LCD, the MMC message identified by the MMC Token is called from storage in electronics and run, incorporating any System Tokens as specified in the network message. But when a VFD message that does not include an MMC Token is received at an LCD machine, the FIG. 8 emulation screen appears bearing the VFD message in the upper half, and emulating a prior art keypad, which is associated with the VFD in prior art machines. This feature permits gradual introduction of LCD machines on a network and gradual introduction of MMC messages to any LCD machines that are on the network. Multimedia content can thus be downloaded on the gaming-machine network and displayed on the LCD as described above.

Figure 8:
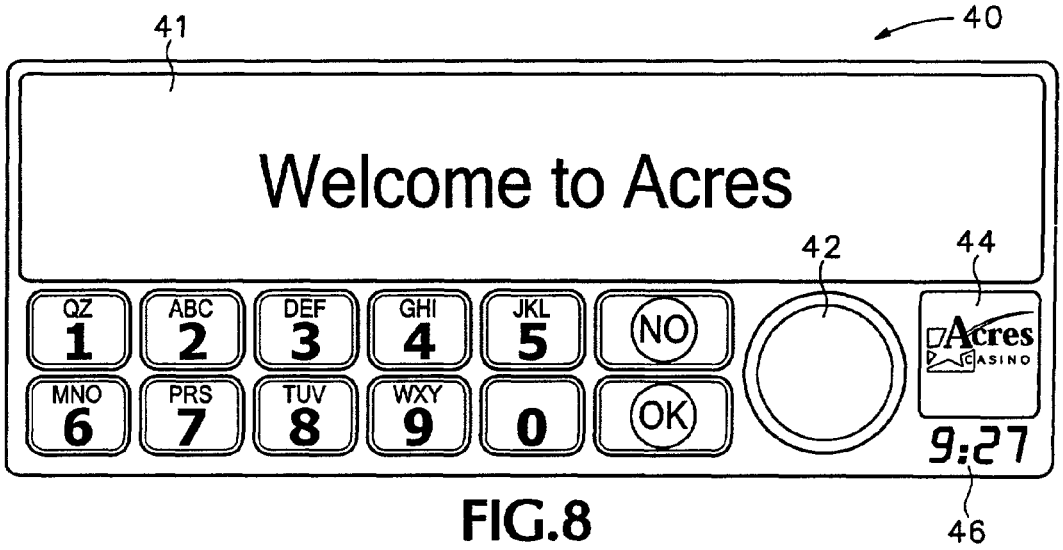
FIGS. 8-26 are enlarged views of the display screen depicted in FIG. 7 with images displayed thereon as described in the following detailed description.

In FIG. 8, display 16 is shown with an image that appears when the system emulates a prior art vacuum florescent display (VFD), like that disclosed in the '961 and '125 patents. The touch screen display image includes a keypad 40, a message screen 41, a bonus button 42, a casino logo 44, and a time display 46. Unless it is otherwise clear from the context, use of the term "button" herein refers to an image of a button on the touch screen, which enables a player to interact with the network by touching screen 16 over the button image. The casino operator has the option, implemented via the Content Manager, of displaying various features such as the bonus button and the system time, dependent upon the operator's preference. Emulation mode is advantageous in two situations. First, if the touch screen display has not been configured, or configured incorrectly, the image of FIG. 8 appears. Second, when prior art systems are retrofitted to include some slot machines that incorporate the touch screen LCD of the present invention and others that incorporate the prior art VFD, there may be some network display messages that are not implemented with the multimedia content ("MMC") used by LCD 16. If so, the system defaults to VFD emulation mode, in which VFD messages are displayed on message screen 41, while the player enters commands using keypad 40 and bonus button 42. In this mode, touch keypad 40 and the message panel 41 emulate the behavior of the prior art VFD and keypad, respectively.

In another embodiment of the invention, a separate network, i.e., a different network from one computer 30 is on, is connected to board 39. This separate network provides MMC to board 39 for displaying images or playing audio. Such a network could be used to deliver real-time multimedia content to the display 16 and speakers 42, 44. In addition, this network is used to deliver real-time video, either broadcast or closed circuit, to the display while play is ongoing. The keypad image on the touch screen display is used by the player to select a broadcast or closed-circuit channel. This configuration could permit a player to watch, e.g., a sporting event or other show while gaming.

Figure 9:
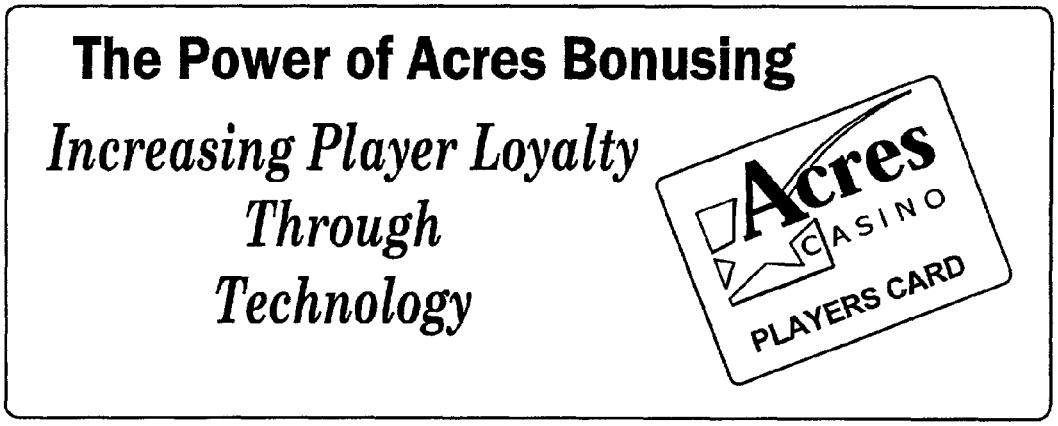

FIG. 9 depicts an example of display 16 in idle-attract mode, i.e., when there is no player card inserted in slot 20. When there is no card, the system displays up to 32 full size screens in a repeating sequence. Using a computer and keyboard on the network, the operator can control the duration, time of day, and sound associated with the idle-attract mode.

Figure 10:
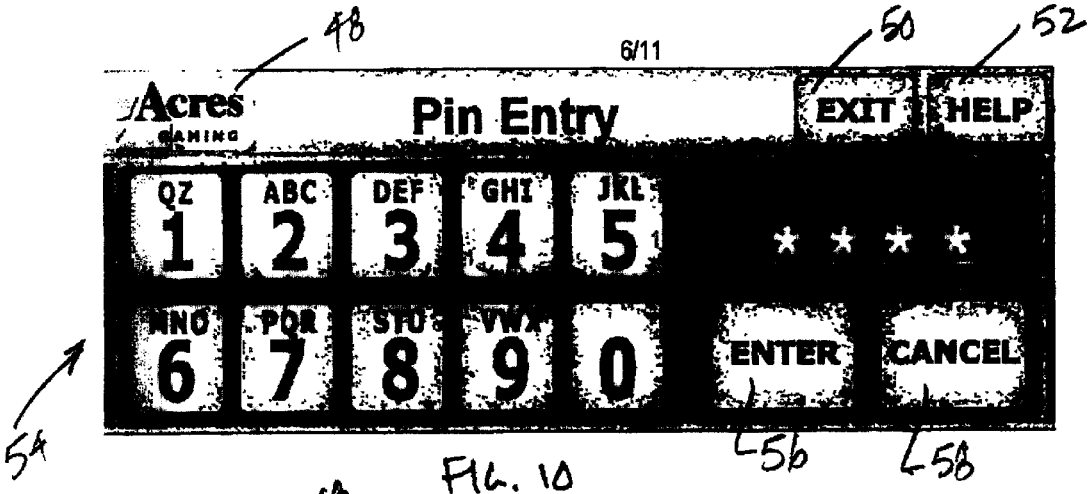
Figure 14:
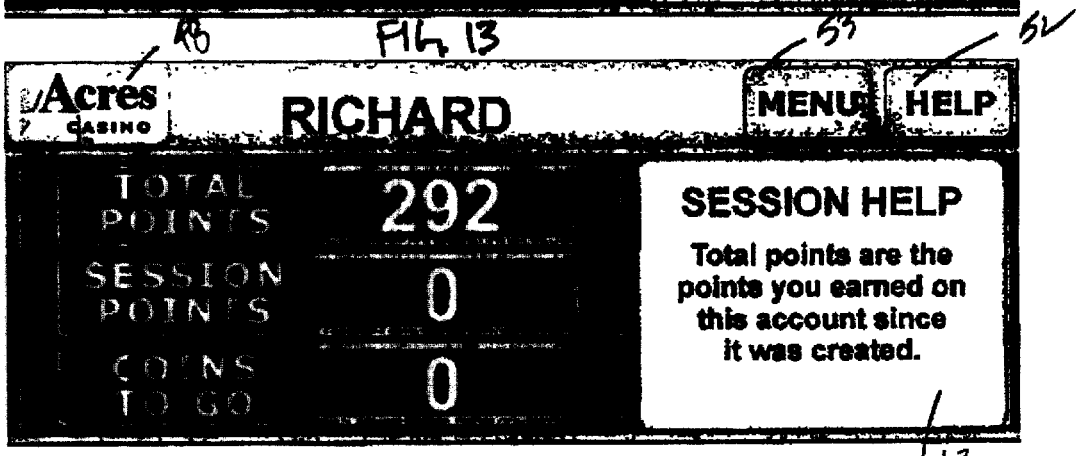

Turning to FIG. 10, the display is shown as it appears after a player enters his or her card into slot 20 of the card reader. This display includes a title, Pin Entry, PIN being an acronym for Personal Identification Number, a number that is stored on the network in association with the player's account. Also included is a casino logo 48, in the present embodiment of the invention, the logo of the assignee being utilized for illustrative purposes. In the upper right-hand corner of the display are an Exit button 50 and a Help button 52. Exit button 50 permits the player to cancel current operations or to move back to the previous screen. In FIG. 10, if Exit button 50 is pressed, the system resumes the idle-attract mode of FIG. 9. Pressing Help button 52 retrieves up to 8 screens of help information (e.g., as shown in FIG. 14) that can be configured on the Content Manager.

The display of FIG. 10 also includes a touch keypad 54, a touch Enter button 56, a touch Cancel button 58, and a PIN entry field 60, which displays an asterisk each time a digit from the player's PIN is entered on keypad 54.

In operation, when a player enters his or her card into slot 20, the FIG. 10 image appears on display 16. The player enters the PIN associated with the player card by pressing the digits on keypad 54 and hitting Enter button 56. The Content Manager can be used to change the number of PIN digits required. There is also an auto enter feature that can be implemented at the Content Manager that sends the PIN to board 31 without waiting for the player to push the Enter button.

Figure 11:
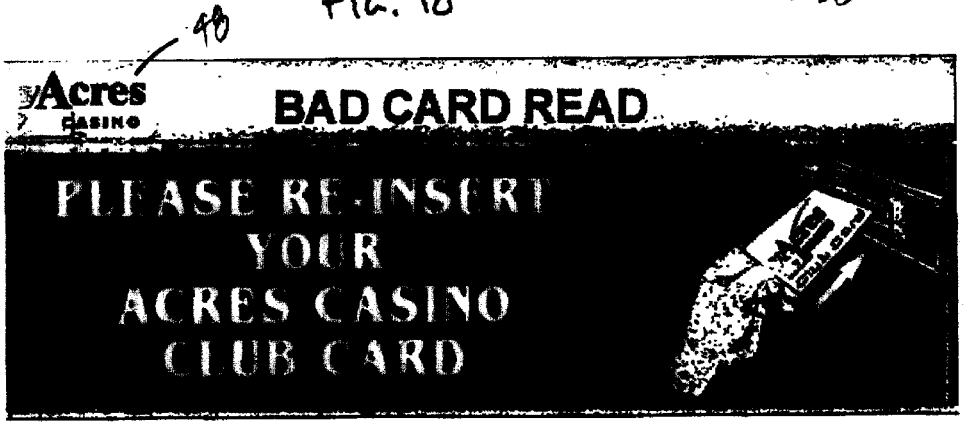

If, however, a player's card format cannot be recognized when it is inserted into slot 20, the display of FIG. 11 appears.

Figure 12:
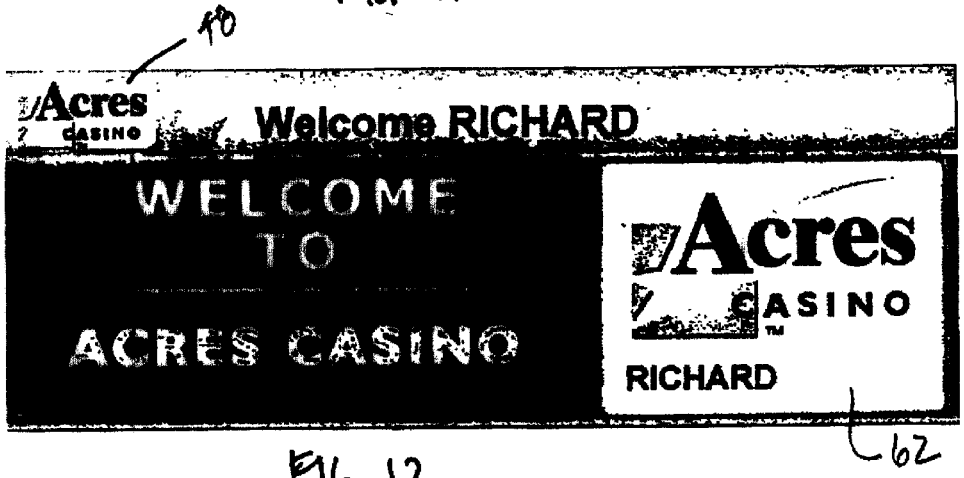

When the format is recognized and the PIN is transmitted to board 31, the card information and PIN stored on a network computer is compared with those entered at slot machine 10. If there is a match, the image of FIG. 12 is displayed. The FIG. 12 image includes a personalized welcome, using the name associated with the player account, and a replica of the player card 62. Speakers 42, 44, also play accompanying audio. The system operator can control the colors on the image of FIG. 12 via the Content Manager. The screen will persist on the display for up to 30 seconds, a time that can also be configured by the operator on the Content Manager.

In addition, the system is configured to require the PIN as described above each time the player is either requesting personal information, such as cash or point balances, or issuing commands to effect account changes, such as transferring cash to or from a slot machine. This provides increased account security, including protecting the player's account in the event that he or she leaves the game without withdrawing the card.

Figure 13:
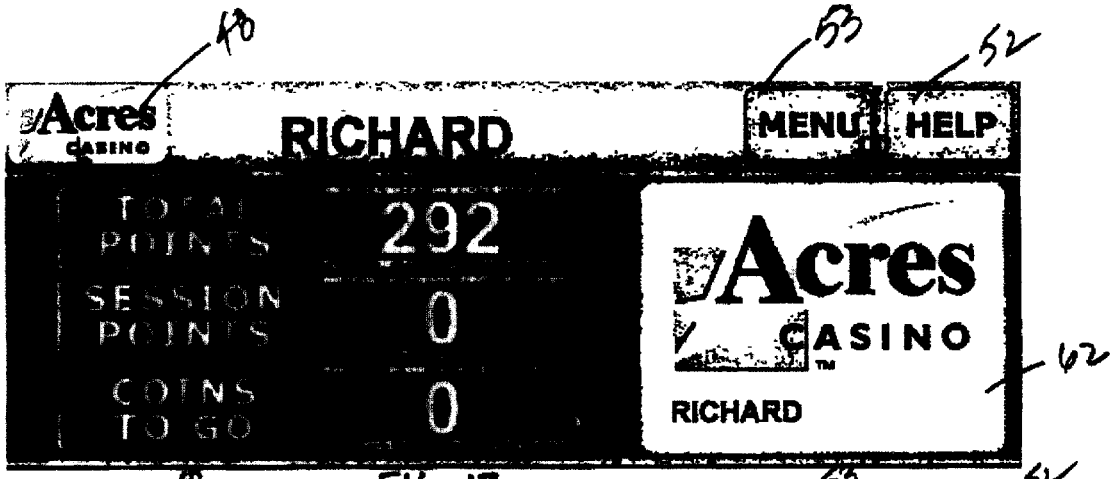

After the welcome screen of FIG. 12, a session screen, shown in FIG. 13 is displayed. A Menu button 53 calls the image of FIG. 17 as later discussed in more detail. The session image includes the player's name at the top and displays and updates the player's total player tracking points (Total Points), points accrued during the current session (Session Points), and additional coins to play necessary to generate additional points (Coins to Go). The Coins to Go display can be enabled or not depending upon the operator's preference, using the Content Manager. The image of FIG. 13 persists until the player takes some action or the system interrupts the session screen with a higher priority display. FIG. 14 depicts another image of the FIG. 13 session screen after Help button 52 is touched. This displays a stored help screen relating to—in this case—the session screen. The help displayed is in the context of the current screen upon which Help button 52 is touched, i.e., the help relates to the display on the current screen.

Figure 15:
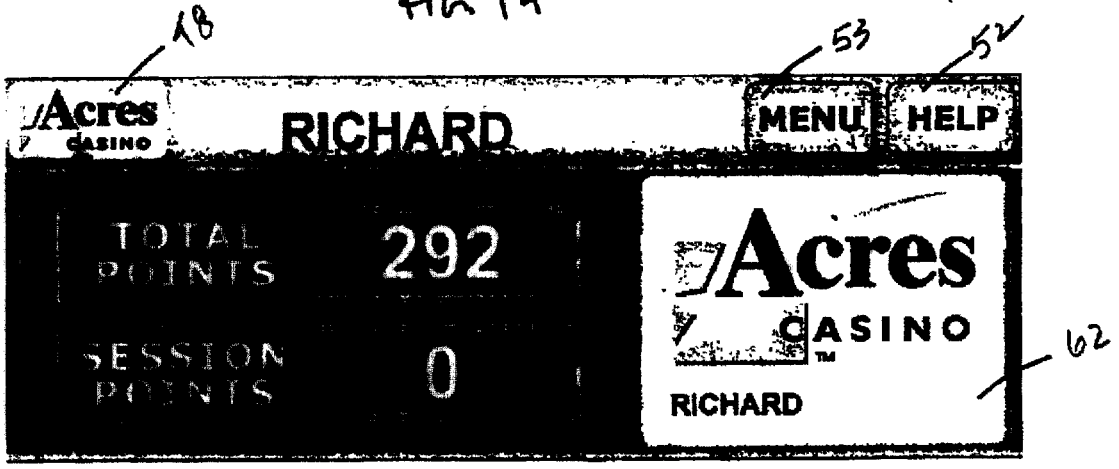

FIG. 15 is another version of the FIG. 13 session screen. The FIG. 15 image does not include the Coins to Go field as a result of a configuration command entered by the casino operator on the Content Manager.

Figure 16:
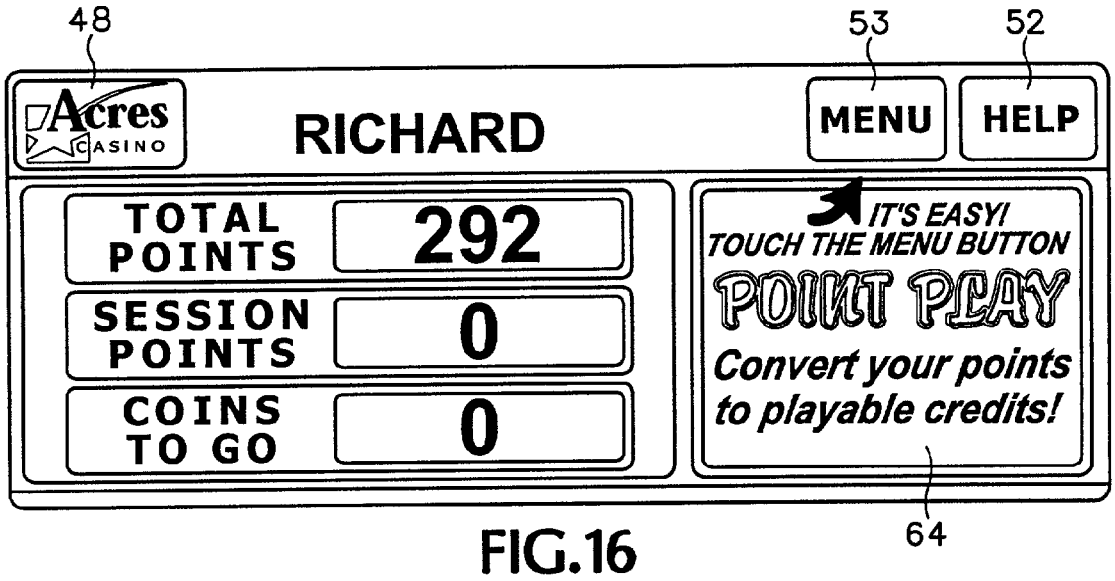

FIG. 16 is still another implementation of the session screen of FIGS. 13 and 15, which includes a session-attract area 64. When the session-attract feature is implemented, area 64 is configurable to display up to 32 screens in any sequence. When the sequence ends, it repeats in round-robin fashion. Each displayable screen has a programmable duration, time of day control, and sound controls, all of which are programmable by the operator using the Content Manager. The session-attract area may also be used to notify players of special events and awards.

Figure 17:
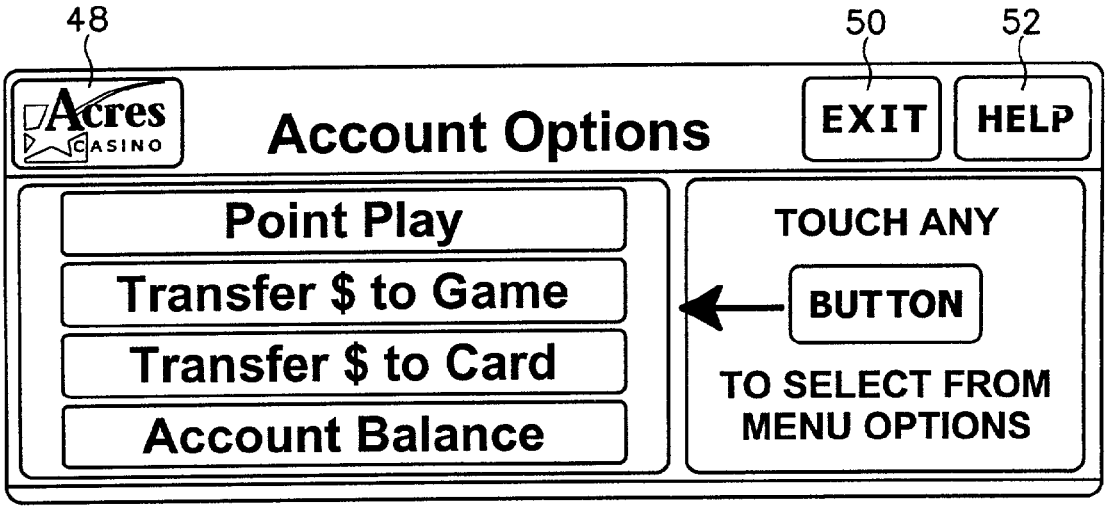

FIG. 17 depicts a menu-mode screen, which is initiated when the player touches Menu button 53. Menu screens contain two touch screen buttons in the upper right-hand corner, namely Exit button 50 and Help button 52. As previously mentioned, the Exit button allows the player to cancel current operations or move back to the previous screen. Any of the four buttons on the left are pushed to select different menu options.

Figure 18:
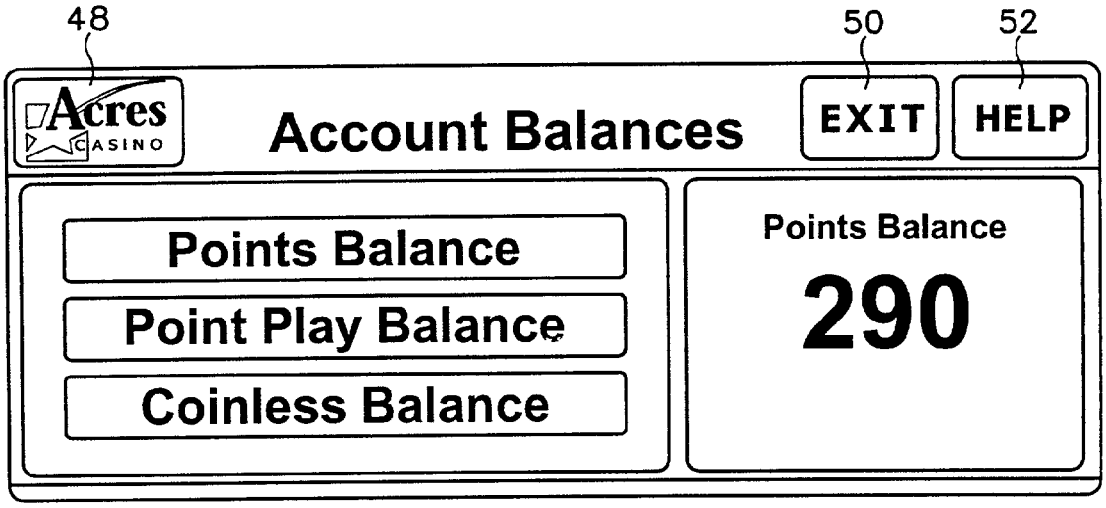

For example, touching the Account Balance button in FIG. 17 produces the menu display screen of FIG. 18. Pushing each of the buttons on the left of FIG. 18 provides the corresponding balance on the right of the screen. The Points Balance button provides the balance of player tracking points. Touching the Point Play Balance button shows the value of machine credits that have been converted by the player at the gaming machine from player tracking points. These credits are referred to by applicant as Xtra Credit points and are described in applicant's co-pending '065 application.

The Coinless Balance button in FIG. 18 provides a balance for a player's cashless play account as described in applicant's co-pending '598 application.

Figure 19:
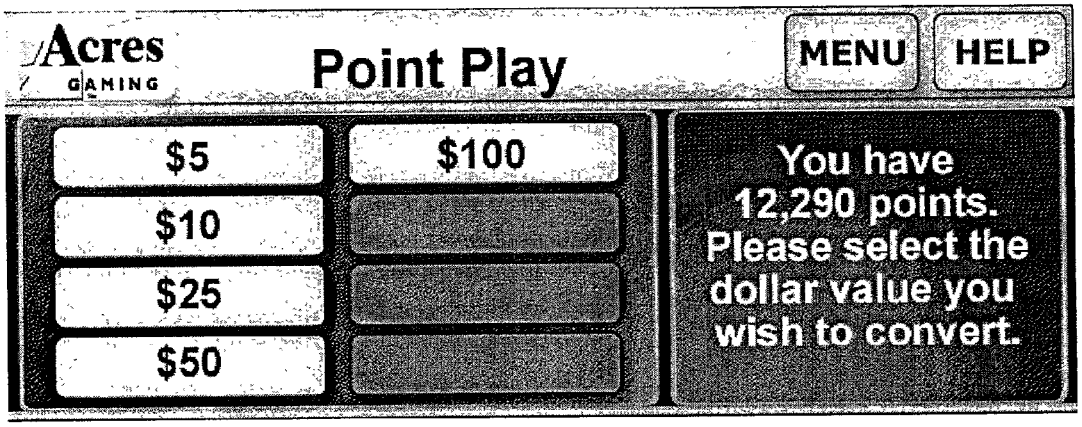
Figure 20:
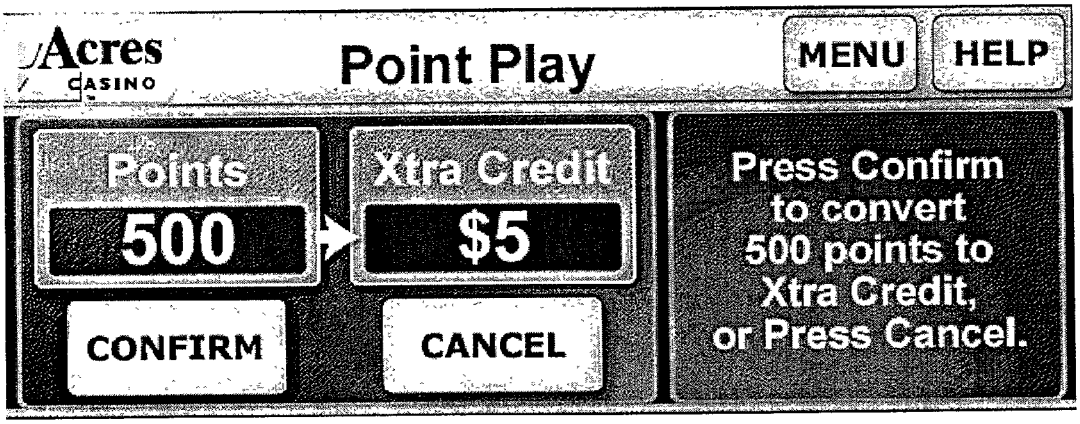

Returning again to FIG. 17, when Point Play button is touched, the image of FIG. 19 appears on the screen. This is the feature that allows players to convert their point balances into game playable credits (Xtra Credit). On the image of FIG. 19, the player selects one of the dollar amounts of credits that he or she wishes to exchange for points in the player's account. Touching, e.g., the $5 button in FIG. 19 produces the Point Play image of FIG. 20. Touching the Confirm button in FIG. 20 moves $5.00 of Xtra Credit to the player's Xtra Credit account, designated "Point Play Balance" in FIG. 18.

Figure 21:
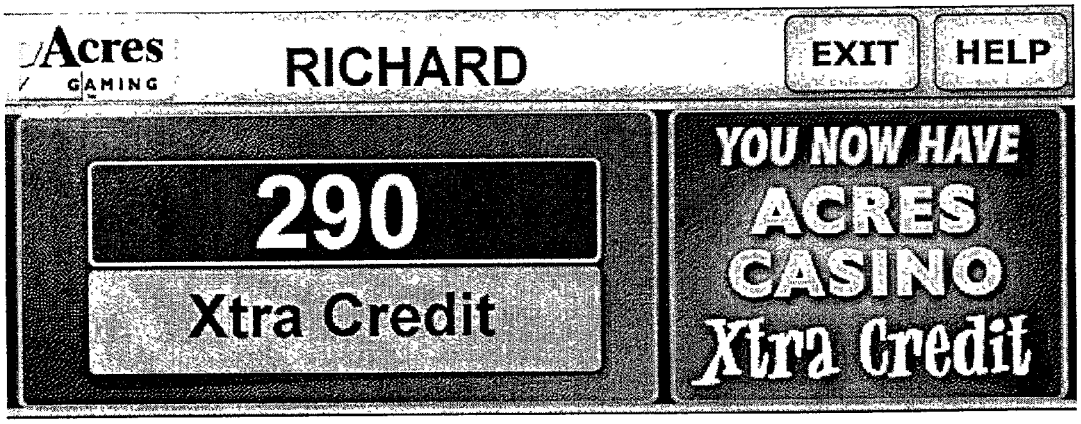

Turning now to FIG. 21, an Xtra Credit display replaces the Welcome display of FIG. 12 when a player has Xtra Credit. The player then plays off any Xtra Credit, and—after doing so—the session screen, like, e.g., the session screen of FIG. 13, is displayed.

Figure 22:
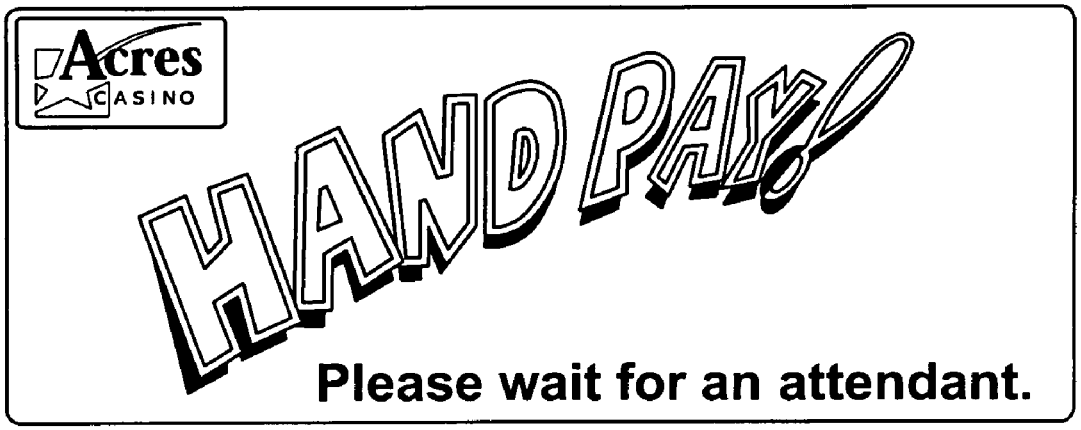

FIG. 22 illustrates a Hand Pay display, which appears whenever the slot machine is in a hand pay condition. This typically occurs for large jackpots or bonus awards that are too large to apply to the machine's credit meter. This display persists until the hand pay condition is cleared from the slot machine, typically by an attendant who arrives to clear the machine in a known manner.

Figure 23:
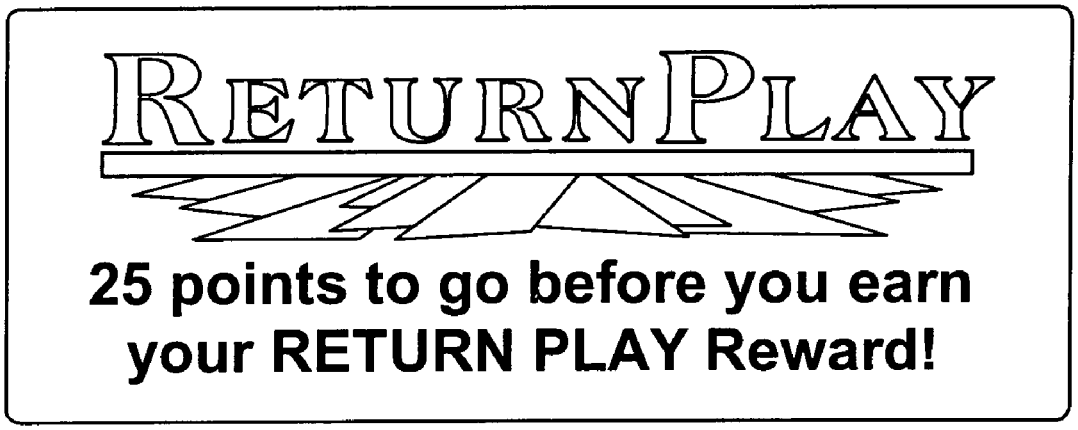

FIG. 23 depicts a Return Play screen which is associated with the return play bonus, described in the '961 patent. Briefly, upon earning a pre-determined number of points in a session, the player is awarded gaming credits that cannot be played until after a pre-determined later time. This induces the player to return to the casino to play off his or her credits.

Figure 24:
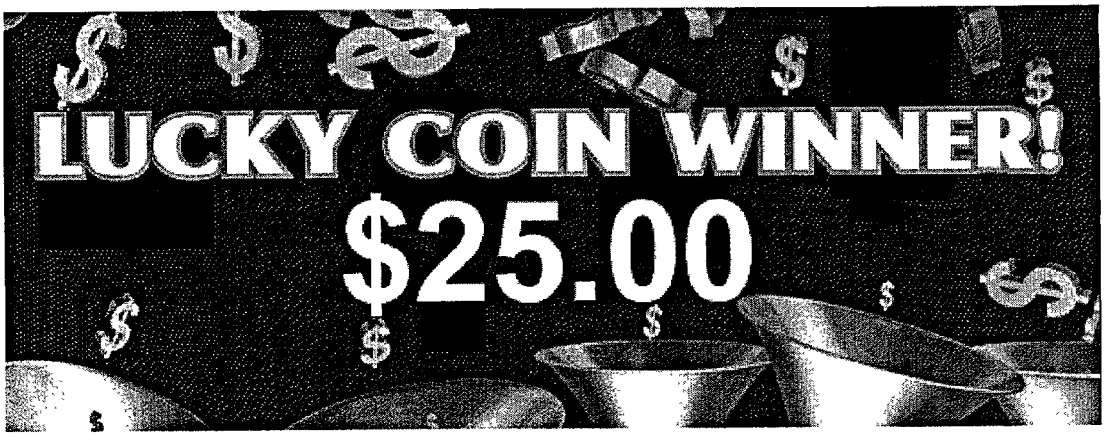

FIG. 24 depicts a screen that appears when the player is a winner of the Lucky Coin bonus, a random award that is described in applicant's U.S. Pat. No. 6,375,569, issued Apr. 23, 2002.

Figure 25:
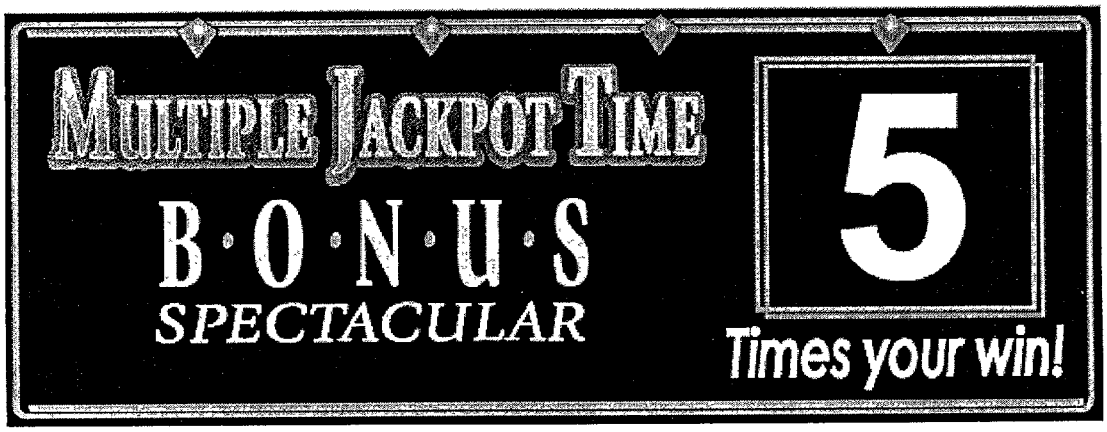

FIG. 25 informs the player that the multiple jackpot bonus is in effect, a bonus promotion described in the '961 patent.

Figure 26:
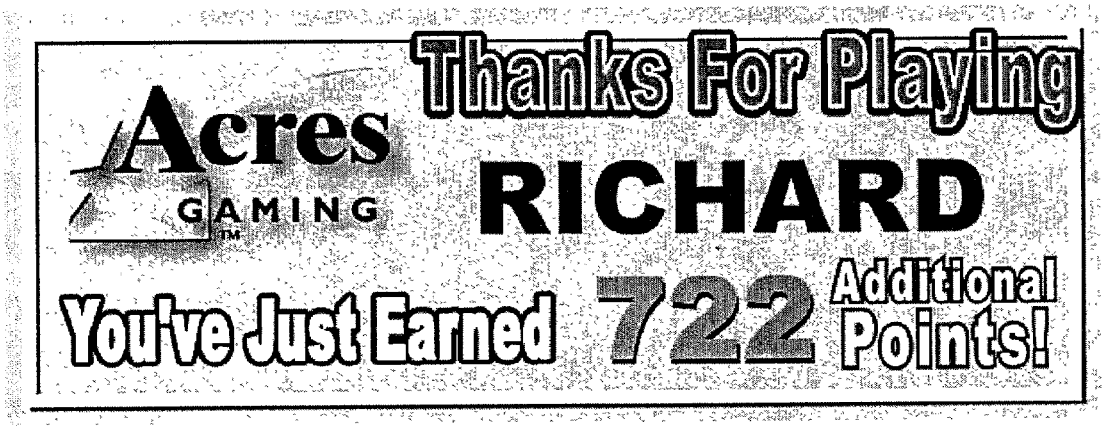

Upon withdrawal of the player's card, the image of FIG. 26 is displayed. The image persists on the screen for a period of up to 10 seconds, which can be designated by the operator on the Content Manager.

In another aspect of the present invention, the display can be used to implement what are sometimes referred to as secondary or top-box games. For example, U.S. Patent Application Ser. No. 60/282,703 discloses a secondary game that includes a display mounted on the top of a commercially available slot machine. The same secondary game can be implemented via software stored on board 38. This software can drive display 16 in the same fashion as the upper portion of the game described in the '703 application. A percentage of each coin played in a session can be allocated to a pool personal to the player. This pool can fund an award resulting in playing the secondary game implemented on display 16. The sound associated with that secondary game is played via speakers 42, 44.

In addition, a subset of slot machines on the casino network can be grouped to provide a secondary game in which multiple players participated as shown in U.S. patent application Ser. No. 09/104,145, now U.S. Pat. No. 6,375,567 which is assigned to the assignee of the present application and which is incorporated herein by reference for all purposes. Software implementing that game can be used to cause the display 16 on each of the grouped machines to depict substantially the same graphics associated with the secondary game screen as shown in the '145 application.

Finally, a subset of the slot machines or the entire network could be selected for periodic bonus games that utilize display 16.

The invention claimed is:

1. A method for operating networked gaming devices comprising:

embedding a standard message with multimedia content to create an embedded message, where the multimedia content is directed to touch screen operation of a display of a gaming device in accepting a communication from a player via the touch screen display, the gaming device with the touch screen display having a pay table and configured to accept a wager from the player;

transmitting the embedded message to a plurality of networked gaming devices, the plurality of networked gaming devices including the gaming device with the touch screen display and one or more gaming devices without a touch screen display and configured to receive only standard messages wherein the one or more gaming devices without a touch screen display and configured to receive only standard messages has a pay table and is configured to accept a wager from a player;

displaying the standard message on one or more displays associated with the one or more gaming devices without a touch screen display and configured to receive only standard messages; and using the multimedia content of the embedded message in connection with the touch screen operation of the display of the gaming device with the touch screen display.

2. The method of claim 1, further comprising displaying the embedded message on one or more displays configured to receive embedded messages and accepting a communication from the player in response to the embedded message.

3. A method for operating gaming devices coupled by a network, the method comprising:

generating a first message for a gaming device configured to accept a wager and having a pay table and a first type of display;

transmitting the first message to a gaming device configured to accept a wager and having a pay table and a second type of display wherein the display of the second type is different than the display of the first type;

emulating a representation of the display of the first type on the gaming device having the display of the second type in response to the first message;

displaying the representation on the gaming device having the display of the second type to emulate the behavior of the display of the first type; and displaying the first message on a gaming device having the display of the first type.

4. The method of claim 3, wherein generating a first message for a gaming device having a first type of display comprises generating a first message for a gaming device having a VFD display.

5. The method of claim 4, wherein transmitting the first message to a gaming device having a second type of display comprises transmitting the first message to a gaming device having an LCD display.

6. The method of claim 3, wherein emulating a representation of the display of the first type comprises emulating a key pad on a portion of the display of the second type.

* * * * *